United States Patent [19]

Sumerau

[11] Patent Number: 4,757,574

[45] Date of Patent: Jul. 19, 1988

[54] LIGHT PLATE FOR VACUUM CLEANER

[75] Inventor: William R. Sumerau, Easley, S.C.

[73] Assignee: The Singer Company, Stamford, Conn.

[21] Appl. No.: 147,472

[22] Filed: Jan. 25, 1988

[51] Int. Cl.[4] ..... A47L 9/30

[52] U.S. Cl. ..... 15/324; 362/31; 362/91

[58] Field of Search ..... 15/324; 362/26, 31, 362/91

[56] References Cited

U.S. PATENT DOCUMENTS

| | | | |
|---|---|---|---|
| 2,217,174 | 10/1940 | Langille | 15/324 |
| 2,274,971 | 3/1942 | White | 362/31 |
| 2,475,400 | 7/1949 | Osborn | 15/324 X |
| 4,282,560 | 8/1981 | Kringel et al. | 362/26 |
| 4,322,781 | 3/1982 | Peterson | 362/32 |
| 4,660,246 | 4/1987 | Duncan et al. | 15/329 |

*Primary Examiner*—Chris K. Moore
*Attorney, Agent, or Firm*—David L. Davis

[57] ABSTRACT

A vacuum cleaner main chassis incorporates a light plate for providing light from a relatively narrow slot extending across the front of the chassis onto a floor surface to be cleaned. The light plate is generally planar and transmits light therethrough within its plane from an input edge of the plate to an opposite output edge thereof. The plate output edge resides in the chassis front slot while the rest of the plate is enclosed within the chassis so that light emerges from the chassis only through its front slot. The slot is relatively close to the floor surface for illuminating an area thereof beginning relatively adjacent the chassis. Lamps located adjacent the relatively rearward input edge of the light plate are thus positioned relatively remote from a suction nozzle and rotatable bar brush located in a forward area of the chassis, which avoids preempting critical space in such area or interfering with operation of such elements. The light plate is also pivotable about an axis located rearwardly of the bar brush, and extends thereacross for pivoting upward to permit access to the bar brush for its removal and maintenance.

15 Claims, 2 Drawing Sheets

LIGHT PLATE FOR VACUUM CLEANER

BACKGROUND OF THE INVENTION

The present invention concerns in general the illumination of a floor surface to be cleaned with a vacuum cleaner, and more particularly concerns providing a vacuum cleaner with an improved built-in illumination means generally in the nature of a light plate.

In general, it is well known to associate a lamp or similar illumination means with a vacuum cleaner for illuminating a floor surface to be cleaned. Various schemes and constructions have been practiced for incorporating a lamp into a chassis of the vacuum cleaner.

For example, with some vacuum cleaners a lens is inserted into a void or gap formed in the chassis cover, with a lamp situated within such chassis behind the lens. U.S. Pat. No. 2,274,971 (issued May, 1942 to White) discloses a vacuum cleaner generally of such type, having a contoured quartz lens received in a passageway through the chassis cover so that light from a lamp provided at one end of the lens is directed by the curvature thereof onto a floor surface to be cleaned. In one White embodiment, light is provided in such general manner with a single, relatively narrow width quartz lens centrally located on the chassis. In another White embodiment, a pair of such respective passageway-lens-lamp combinations are provided in spaced relationship on a chassis for a dual, "headlight" lighting scheme.

In some other vacuum cleaners, a light or lamp is provided within a vacuum cleaner chassis, and situated so as to shine directly through a lens which stands up vertically on the chassis. U.S. Pat. No. 2,475,400 (issued July, 1949 to Osborn) is generally an example of such construction, and includes a chassis hood suitably molded to form a lens or light transmitting window integrally therein. The Osborn hood also further "pipes" light from a lamp behind such lens portion and diverted therefrom to an embossed indicia portion of the hood having edge surfaces which are illuminated by such diverted light.

In general, such prior vacuum cleaners have various inadequacies with respect to illumination of the floor surface to be cleaned (particularly relatively close up to a forward edge of the vacuum cleaner chassis), and/or otherwise with respect to the construction thereof (particularly relating to placement or maintenance of various operative elements within the cleaner chassis).

SUMMARY OF THE INVENTION

The present invention recognizes and addresses such various drawbacks and inadequacies, and others, of prior vacuum cleaners having lamps for illuminating the floor surface to be cleaned. Accordingly, it is one general object of the present invention to provide a vacuum cleaner having improved built-in lamp features.

It is another general object to provide an improved vacuum cleaner which more effectively illuminates the floor surface to be cleaned, without otherwise comprising operational features thereof concerning vacuuming operations. Another such general object is to provide such an improved vacuum cleaner which advantageously incorporates a lamp means into its chassis, but without reducing placement and/or maintenance advantages of other features and elements of the vacuum cleaner.

It is a more particular object to provide an improved vacuum cleaner which enables a source of light thereof to be located relatively remote from a forward edge of the cleaner chassis, while outputting light from such forward edge so as to provide an illuminated area beginning relatively close thereto.

It is yet another more particular object of the present invention to provide such an improved vacuum cleaner which incorporates a light plate for effectively providing illumination across substantially the full lateral width of a forward edge of a vacuum cleaner chassis, preferably relatively adjacent a suction nozzle area thereof for the improved illumination of a floor surface about to be cleaned. Such a vacuum cleaner may incorporate a light plate which has an input edge located generally rearward of the chassis forward edge, to permit the desireable relatively remote placement of a light source within the chassis.

It is yet a further alternative object of the present invention to provide such an improved vacuum cleaner incorporating a light plate which is pivotably mounted within such chassis to permit access to particular features and elements of such vacuum cleaner (such as a nozzle or bar brush thereof) for maintenance of such elements.

Various aspects and features of the present invention in furtherance of such objects, as well as other objects, will be evident from the following disclosure. Furthermore, alternative combinations of such presently-disclosed features and aspects, and functional equivalents thereof, may be provided for practicing various embodiments in accordance with the present invention.

One such exemplary embodiment of this invention concerns a vacuum cleaner, comprising a mobile chassis with a suction nozzle located generally along a forward edge thereof on a chassis underside, such mobile chassis being adapted for movement over a floor surface to be cleaned; a collection bag carried on such chassis; suction means carried on the chassis for drawing air from the nozzle to the bag, so as to suction dirt and dust adjacent the nozzle into said bag; a rotatable bar brush journaled generally in the suction nozzle, and removable therefrom for maintenance of the brush; and illumination means, pivotably mounted on such chassis generally rearward of the bar brush and having a forward free pivoting output edge located substantially along the chassis forward edge whenever the free edge is pivoted into engagement therewith, for illuminating generally in front of the chassis forward edge a floor surface to be cleaned by providing light on such surface from the output edge; wherein such illumination means may be selectively pivoted upward about the rearward mounting thereof to facilitate removal of the bar brush for maintenance.

Yet another exemplary vacuum cleaner having improved floor illumination features in accordance with the present invention comprises a main chassis having a lower side to be supported on a floor to be cleaned, and a removable upper cover; a main suction nozzle defined in the chassis lower side and extending laterally across substantially the width of the chassis front; a dirt collection bag carried on the main chassis; suction means for suctioning debris from adjacent the main suction nozzle to the dirt collection bag, such suction means including a vacuum channel interconnecting the nozzle with the bag, and a motorized blower unit associated with the channel for creating therein a flow of air from the nozzle to the bag; a rotatable beater bar brush removably mounted within the vacuum channel relatively adjacent and parallel to the main suction nozzle; a support bracket, pivotably mounted within the chassis beneath the upper cover thereof; a generally planar light plate integrally incorporated into the support bracket, the plate having an output edge positioned generally parallel to, and extending substantially across the width of, the chassis front, and further having an input edge rearward thereof, with light input to the input edge being generally transmitted through the plane of the light plate for exiting the output edge thereof distributed therealong; and light means, supported on the support bracket adjacent to and rearward of the light plate input edge, for providing input light to the light plate input edge; whereby a floor to be cleaned is illuminated with light transmitted through the light plate, originating from the light means generally rearward therefrom.

Still another exemplary construction in accordance with this invention includes a vacuum cleaner, comprising a main chassis having separable upper and lower members; a relatively low bumper edge defined across a front edge of the chassis lower member; a main suction nozzle defined in the chassis lower member, relatively adjacent to and parallel with the front edge thereof; a relatively narrow lateral slot defined between the chassis upper and lower members when same are joined, such slot residing parallel to and just above the bumper edge and extending laterally for substantially the full width thereof; a generally planar light plate residing within the chassis between the upper and lower members thereof, having an output edge on one side thereof residing substantially within and along the lateral slot, and further having an input edge on an opposite side thereof generally rearward of such output edge; and lamp means, located generally rearward of the chasis lower member front edge and removed from the main suction nozzle so as to avoid interference with same, for illuminating the light plate input edge; whereby light entering the light plate input edge from the lamp means is transmitted through the plate substantially in the plane thereof and out the output edge thereof for the illumination, beginning relatively adjacent to the bumper edge, of a floor surface to be cleaned.

Those of ordinary skill in the art will appreciate and be able to practice variations and modifications to features and elements of the present invention, without departing from the spirit and scope thereof, particularly upon studying the further description thereof which follows.

BRIEF DESCRIPTION OF THE DRAWINGS

A complete and enabling disclosure of the present invention, including the best mode thereof, is set forth below, including reference to the accompanying drawings, in which.

Figure 1:
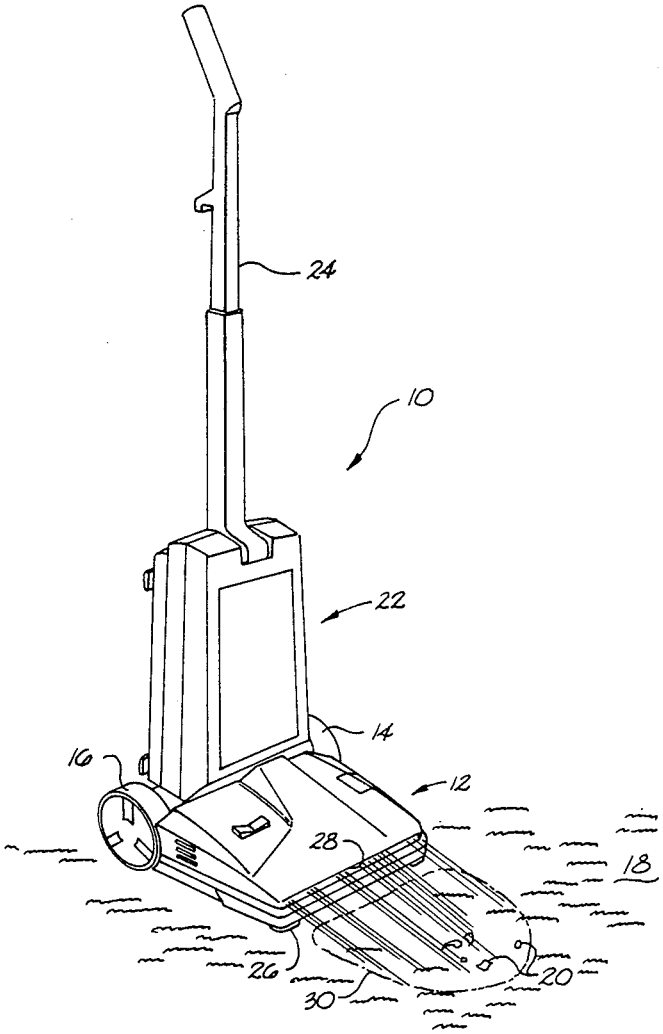
FIG. 1 is a perspective view of an exemplary vacuum cleaner embodiment incorporating features in accordance with the present invention.

Repeat use of reference characters in the following specification and accompanying drawings is intended to represent same or analogous features or elements of the present invention.

DETAILED DESCRIPTION OF THE PREFERRED EMBODIMENT

Teachings and features of the present invention may be practiced with various vacuum cleaner constructions, particularly those having a main chassis. By way of illustration and example only, present FIG. 1 illustrates a general representation of a convertible upright-type vacuum cleaner 10 such as more particularly disclosed and discussed in U.S. Pat. No. 4,660,246 (issued to Duncan et al., and commonly assigned with the present application). The disclosure of Duncan et al. is incorporated herein by reference, particularly with respect to non-essential features of this invention such as concerning more general vacuuming operations.

In general, vacuum cleaner 10 includes a main chassis 12 which with wheels 14 and 16 is movably supported on a floor surface 18 to be cleaned. Chassis 12 incorporates suction means (not shown) for suctioning dirt, dust, and other debris 20 from floor 18 and into a collection bag (not shown) carried on chassis 12 within a body portion 22. In general, a handle 24 is used (as well known in the art) to guide a relatively low forward edge 26 of the vacuum cleaner over floor 18.

More particularly in accordance with the present invention, light is provided from chassis 12 substantially only along such forward edge 26 thereof from a relatively narrow, lateral slot 28 formed in such chassis, so as to illuminate an area 30 of floor 18 to be cleaned beginning relatively close to such forward edge 26. As illustrated, with the presently preferred exemplary embodiment, illuminated area 30 may be generally semicircular, and preferably begins relatively near such chassis forward edge so as to more effectively illuminate area 30. In other words, no substantial gap exists between chassis forward edge 26 and the closest portion of illuminated area 30 thereto, since the placement of slot 28 is advantageously relatively near such relatively low forward edge 26.

Figure 2:
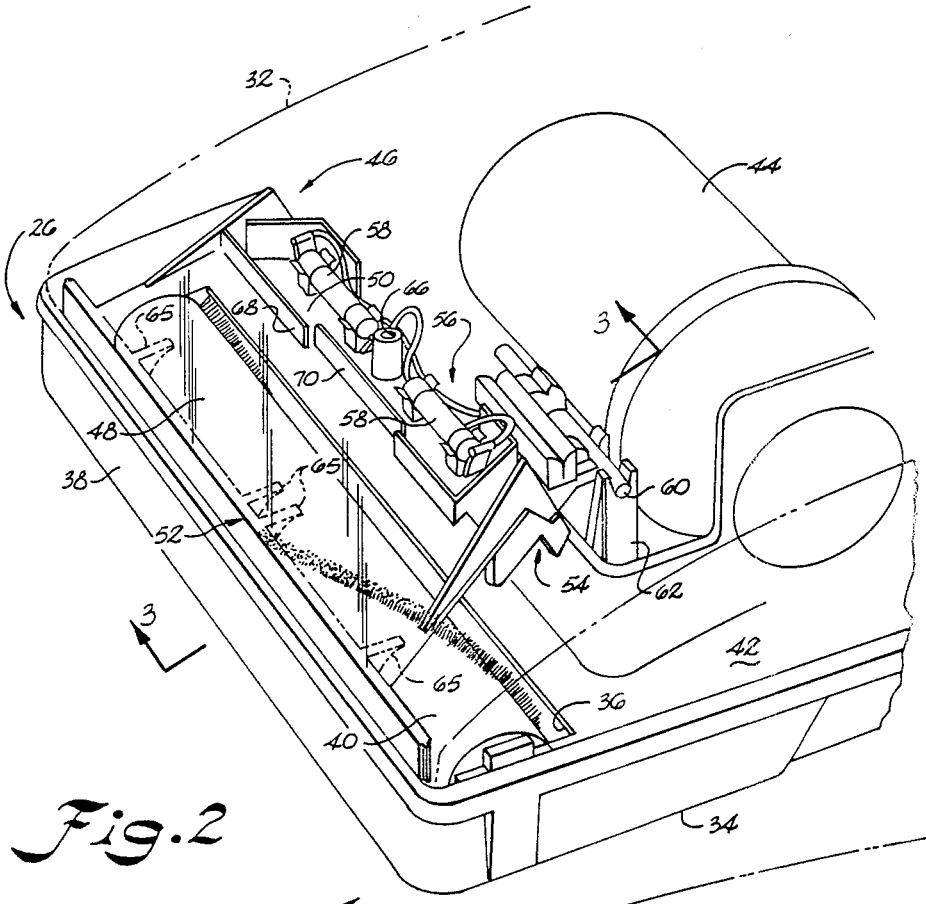
FIG. 2 is an enlarged, partial view of a main chassis portion of a vacuum cleaner such as in present FIG. 1, with an upper member thereof illustrated in dotted line (see-through) for better illustrating internal features of such chassis in accordance with the present invention.
Figure 3:
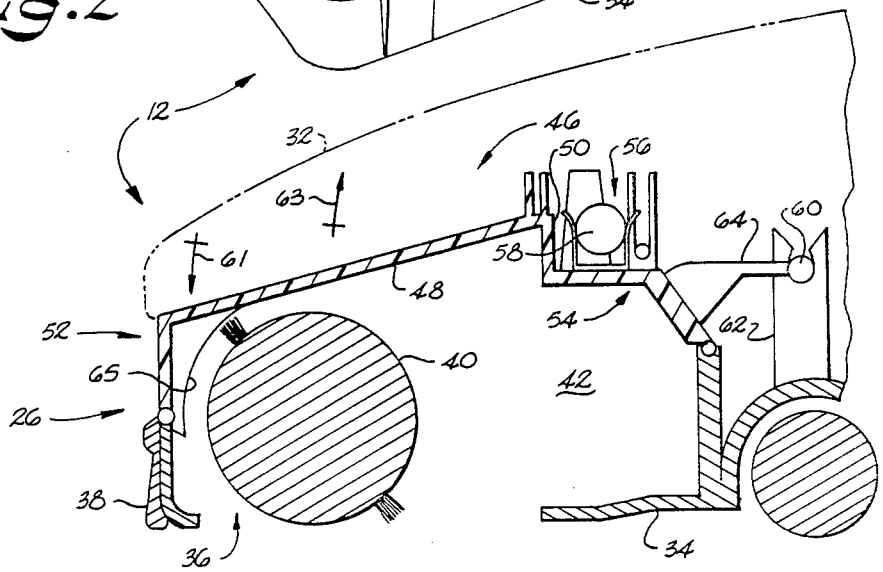
FIG. 3 is a transverse sectional view of the chassis portion of present FIG. 2, taken along the line 3—3 as illustrated therein.

FIGS. 2 and 3 more particulary relate to features of exemplary chassis 12, the construction of which provides the exemplary illumination of floor surface 18 as represented by the illustration of present FIG. 1.

In general, main chassis 12 preferably includes separable upper and lower members 32 and 34, respectively. Lower member 34 is shown in solid lines, while upper member 32 is illustrated in dotted line, representing a see-through illustration of such upper member to permit illustration of features therebeneath (i.e., received within chassis 12 between its two members). Members 32 and 34 may be separably joined in a variety of ways (e.g., bolts, screws, snap-locks, etc., not shown) as known to those of ordinary skill.

A main suction nozzle 36 is defined in an underside or lower side of lower member 34. Preferably, such nozzle 36 is situated generally along and parallel to forward edge 26, which is coterminous with a bumper edge 38 of lower member 34. Such bumper edge is also relatively low (i.e., close to floor 18), and is adapted to withstand contact with objects during vacuum cleaner operations, as particularly supported therefor in accordance with alternative features of the present invention, discussed in greater detail below.

To further facilitate vacuuming of debris from a floor surface adjacent to main suction nozzle 36, it is known to also provide a rotatable beater bar brush 40 journaled within or adjacent to main suction nozzle 36. It is also known for brush 40 to be removably mounted (not represented) for ease of cleaning, replacement, or other maintenance thereof.

For efficient vacuuming operations, both main suction nozzle 36 and bar brush 40 adjacent thereto laterally extend substantially the full width of forward edge 26 in a forward area of chassis 12. A vacuum channel 42 generally extends rearward of such forward area and cooperates with a motorized blower unit 44 to provide suction means, as known by those of ordinary skill in the art. Vacuum channel 42 in particular interconnects the forward area around suction nozzle 36 and bar brush 40 with the above-mentioned dirt collection bag (not shown).

Such general chassis construction provides an efficient vacuum cleaner chassis layout, as generally known in the art. Furthermore, the separability of upper and lower chassis members 32 and 34 (i.e., the removability of upper member 32 from lower member 34) advantageously permits access to bar brush 40 for its removal and/or maintenance. Practice of the present invention particularly provides for the further combination of, or inclusion of, illumination means features with such an advantageous chassis construction or layout (or others), without adversely affecting either the placement and operational advantages of such general construction, or the ready maintenance features thereof.

In accordance with the present exemplary embodiment of this invention, illumination means 46 are provided within chassis 12 for illuminating generally in front of chassis forward edge 26 a floor surface or area 30 (FIG. 1) to be cleaned by vacuum cleaner 10.

Such illumination means preferably includes a light plate 48 integrally incorporated therein. Light plate 48 preferably comprises a substantially planar member of optical plastic for transmitting light therein generally parallel to (i.e., within) the plane thereof. More particulary, input light provided at an input edge 50 extending along one side of light plate 48 is transmitted substantially within the plane of such plate and exits along an output edge 52 thereof. Output edge 52 is situated on an opposite side of plate 48 from input edge 50 thereof. Thus, light is transmitted within the plane of the plate generally from one edge to an opposite, output edge thereof. It is such output edge which is received in and substantially fills relatively narrow, lateral slot 28 (see FIG. 1) defined between joined chassis members 32 and 34.

Illumination means 46 may in another sense be considered as a support bracket 54 mounted within chassis 12 beneath upper member 32 thereof. Light plate 48 preferably is integrally associated with such support bracket 54, as illustrated. When so integrally incorporated, the forward edge of bracket 54 is coterminous with light plate output edge 52. Alternatively, light plate 48 may be otherwise carried on or supported by bracket 54.

Additional elements or features may be associated with bracket 54. For example, light means 56 may be supported on support bracket 54 adjacent to and rearward of light plate input edge 50, for providing input light to such input edge for subsequent transmission through plate 48 for the illumination of a floor surface to be cleaned, as discussed above. Various alternative constructions may be practiced, but it is generally preferred that such light means include a pair of series-wired cartridge lamps 58 (e.g., 12 volt lamps) supported on bracket 54 in co-planar alignment with input edge 50.

With such a light means configuration in cooperation with the remaining illustrated chassis construction, any light that is kept within a certain angle, such as 6° , of the plane of light plate 48 will be reflected back into itself (i.e., remain within such plane). Incident light exceeding such angle instead breaks through the surface of plate 48, but does not transmit randomly from chassis 12 since only the area of light plate 48 exposed through relatively narrow, lateral slot 28 (i.e., output edge 52) can transmit light to the outside of chassis 12.

While light plate features of this invention are not limited to particular dimensions, general measurements for the presently illustrated exemplary embodiment are as follows. The lateral width of chassis 12 is about 12 inches (i.e., roughly 30 centimeters). Chassis depth (i.e., from forward edge 26 to the back of wheels 14 and 16) is also roughly 12 inches. The lateral width of slot 28 (and of output edge 52 of light plate 48) is about 11 inches. The thickness of output edge 52 is only about one centimeter, or less, while the thickness of plate 48 in its planar region is generally in a range of about $\frac{1}{4}$ to $\frac{1}{2}$ of a centimeter. The separation of input edge 50 from output edge 52 is preferably about 4 to 5 centimeters.

Such construction advantageously permits effective lighting relatively adjacent to and across substantially the full width of the chassis forward edge, without disrupting or interfering with the other discussed elements and features of such chassis. Also, even with alternative chassis constructions, use of a light plate having an input edge extending rearwardly of the forwardmost area of the chassis permits relatively remote locating of the light source 56, while yet providing the foregoing illumination advantages.

As yet a further alternative feature which may be practiced in accordance with the present invention, entire illumination means 46 may be pivotably mounted within chassis 12 about a pivot axis 60. Whenever illumination means 46 (i.e., bracket 54) is pivoted downward (eg., in the direction of arrow 61) so that the forward pivoting free end thereof is generally in contact with chassis forward edge 26 (as illustrated in present FIGS. 2 and 3), light plate 48 and the above discussed features are appropriately positioned for obtaining the illumination advantages outlined above.

Pivoting of support bracket 54 from the positions illustrated to a position generally upward therefrom (i.e., in the direction of arrow 63) advantageously provides access through the chassis (with member 32 removed) to rotatable bar brush 40. Since such bar brush is removable for cleaning or replacement (i.e., maintenance), upward pivoting of light plate 48 permits ready access to such bar brush without adversely affecting or detracting from other features and operations of the subject vacuum cleaner.

Rotatable axis 60 may be supported within chassis 12 by a support member 62 integrally formed therein. One such support bracket, and its corresponding pivoting arm 64 comprising a rearward extension of bracket 54, is generally adequate for support and pivoting of the entire illumination means 46 (though alternative constructions providing equivalent operation may be practiced in accordance with the present invention).

Whenever light plate 48 is pivoted downward (arrow 61) so that a forward output edge thereof engages and contacts a forward chassis edge, one or more engagement or stop members 65 may be provided for engaging the relatively low bumper edge 38. Such engagement provides additional support for the bumper edge in the event it should strike objects during the course of vacuum cleaning operation, which support reduces inward deflection of the edge.

As an additional aspect of pivotably mounted illumination means 46 (or even with practice of an embodiment omitting the illustrated pivoting feature thereof), support bracket 54 and light plate 48 also serve to define at least a portion of one side wall of vacuum channel 42, particularly in the forward chassis area around suction nozzle 36 and bar brush 40.

While specific features have been illustrated and discussed in connection with the present exemplary embodiment, those of ordinary skill in the art will understand that further features, and alternatives thereto and equivalents thereof, may be practiced. For example, a cover or the like may be provided over lamp means 56, and secured thereto with a screw received in threaded opening 66, or by a clip-on element received between opposing members such as 68 and 70. All such additional features and variations, as well as equivalents for and modifications to other features discussed above, are intended to come within the spirit and scope of the present invention by virtue of present reference thereto. Furthermore, the language utilized in the present specification is intended as language of example only, and not limitive to the present invention, which is defined more particularly in the appended claims.

What is claimed is:

1. A vacuum cleaner, comprising:

a mobile chassis with a suction nozzle located generally along a forward edge thereof on a chassis underside, said mobile chassis being adapted for movement over a floor surface to be cleaned;

a collection bag carried on said chassis;

suction means carried on said chassis for drawing air from said nozzle to said bag, so as to suction dirt and dust adjacent said nozzle into said bag;

a rotatable bar brush journaled generally in said suction nozzle, and removable therefrom for maintenance of said brush; and illumination means, pivotably mounted on said chassis generally rearward of said bar brush and having a forward free pivoting output edge located substantially along said chassis forward edge whenever said free edge is pivoted into engagement therewith, for illuminating generally in front of said chassis forward edge a floor surface to be cleaned by providing light on such surface from said output edge;

wherein said illumination means may be selectively pivoted upward about the rearward mounting thereof to facilitate removal of said bar brush for maintenance.

2. A vacuum cleaner as in claim 1, wherein said illumination means includes:

a light plate extending laterally for most of the width of said chassis suction nozzle, said light plate including a generally rearward input edge for receiving light to be transmitted through said plate; and at least one light located adjacent said light plate input edge for providing light which enters said light plate at said input edge, which light is transmitted through said light plate and exits from said illumination means output edge for the illumination of a floor surface.

3. A vacuum cleaner as in claim 2, wherein said at least one light comprises a pair of cartridge lamps situated generally in co-planar alignment with said light plate input edge.

4. A vacuum cleaner as in claim 2, wherein said light plate substantially comprises a planar structure pivotally mounted for extending across said bar brush, so that light is transmitted from an area generally rearward of said bar brush onto a floor surface forward thereof, distributed across the width of said illumination means output edge.

5. A vacuum cleaner as in claim 4, wherein the thickness of said illumination means output edge is relatively thicker than the planar structure of said light plate.

6. A vacuum cleaner as in claim 4, wherein said light plate cooperates with said chassis and its forward edge, whenever said illumination means is pivoted downward into contact therewith, to form at least part of a vacuum passageway residing generally about said bar brush and interconnecting said nozzle to said bag.

7. A vacuum cleaner as in claim 1, wherein said illumination means further includes at least one tab secured to said forward output edge thereof for engaging said chassis forward edge whenever said illumination means is pivoted downward into contact therewith, whereby said forward edge is braced against inward deflection.

8. A vacuum cleaner having improved floor illumination features, comprising:

a main chassis having a lower side to be supported on a floor to be cleaned, and a removable upper cover;

a main suction nozzle defined in said chassis lower side and extending laterally across substantially the width of said chassis front;

a dirt collection bag carried on said main chassis;

suction means for suctioning debris from adjacent said main suction nozzle to said dirt collection bag, said suction means including a vacuum channel interconnecting said nozzle with said bag, and a motorized blower unit associated with said channel for creating therein a flow of air from said nozzle to said bag;

a rotatable beater bar brush removably mounted within said vacuum channel relatively adjacent and parallel to said main suction nozzle;

a support bracket, pivotably mounted within said chassis beneath said upper cover thereof;

a generally planar light plate integrally incorporated into said support bracket, said plate having an output edge positioned generally parallel to, and extending substantially across the width of, said chassis front, and further having an input edge rearward thereof, with light input to said input edge being generally transmitted through the plane of said light plate for emergence from said output edge thereof distributed therealong; and light means, supported on said support bracket adjacent to and rearward of said light plate input edge, for providing input light to said light plate input edge;

whereby a floor to be cleaned is illuminated with light transmitted through said light plate, originating from said light means generally rearward therefrom.

9. A vacuum cleaner as in claim 8, wherein said support bracket extends generally across said bar brush, pivoting about an axis generally rearward therefrom so that upward pivoting of said support bracket about such pivot axis permits access to said removably mounted bar brush for removal and maintenance thereof.

10. A vacuum cleaner as in claim 9, wherein said support bracket and light plate define at least a portion of said vacuum channel in an area relatively adjacent said main suction nozzle and said bar brush.

11. A vacuum cleaner as in claim 8, wherein said light means comprises a pair of series-wired cartridge lights in substantial co-planar alignment with said light plate input edge for effective provision of light thereto.

12. A vacuum cleaner as in claim 8, wherein:

a forward edge of said support bracket coterminous with said light plate output edge includes stops for engaging and strengthening a forward edge of said main chassis whenever said support bracket is pivoted downward into contact therewith; and said light plate output edge is relatively adjacent a floor to be cleaned so as to project a pattern of illumination thereon beginning relatively near such chassis forward edge, even though said light means is mounted rearward of said light plate.

13. A vacuum cleaner, comprising:

a main chassis having separable upper and lower members;

of said chassis lower member;

a main suction nozzle defined in said chassis lower member, relatively adjacent to and parallel with said front edge thereof;

a relatively narrow lateral slot defined between said chassis upper and lower members when same are joined, said slot residing parallel to and just above said bumper edge and extending laterally for substantially the full width thereof;

a generally planar light plate residing within said chassis between said upper and lower members thereof, having an output edge on one side thereof residing substantially within and along said lateral slot, and further having an input edge on an opposite side thereof generally rearward of said output edge; and lamp means, located generally rearward of said chassis lower member front edge and removed from said main suction nozzle so as to avoid interference with same, for illuminating said light plate input edge;

whereby light entering said light plate input edge from said lamp means is transmitted through said plate substantially in the plane thereof and out said output edge thereof for the illumination, beginning relatively adjacent to said bumper edge, of a floor surface to be cleaned.

14. A vacuum cleaner as in claim 13, further including:

a rotatable bar brush removably mounted within said chassis adjacent said main suction nozzle; and a pivot axis defined within said chassis generally rearward of said main suction nozzle, said light plate being pivotably mounted thereabout and extending forward thereof substantially across said bar brush;

whereby said light plate may be pivoted upward to permit removal of said bar brush for maintenance thereof.

15. A vacuum cleaner as in claim 13, wherein said light plate output edge includes engagement members received thereon for engaging said relatively low bumper edge, for providing additional support therefor to reduce inward deflection of said bumper edge whenever it contacts objects during the course of vacuum cleaner operation.

* * * * *